US007703560B2

(12) United States Patent
Eyre et al.

(10) Patent No.: US 7,703,560 B2
(45) **Date of Patent: *Apr. 27, 2010**

(54) CUTTING ELEMENT WITH CANTED INTERFACE SURFACE AND BIT BODY INCORPORATING THE SAME

(75) Inventors: Ronald K. Eyre, Orem, UT (US); Madapusi K. Keshavan, Sandy, UT (US); David Truax, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/217,706

(22) Filed: Jul. 7, 2008

(65) Prior Publication Data

US 2009/0025985 A1 Jan. 29, 2009

Related U.S. Application Data

(60) Continuation of application No. 11/657,198, filed on Jan. 23, 2007, now Pat. No. 7,395,885, which is a continuation of application No. 11/267,644, filed on Nov. 4, 2005, now Pat. No. 7,165,636, which is a continuation of application No. 10/079,293, filed on Feb. 20, 2002, now Pat. No. 6,991,049, which is a continuation of application No. 09/693,028, filed on Oct. 20, 2000, now Pat. No. 6,405,814, which is a division of application No. 09/103,824, filed on Jun. 24, 1998, now Pat. No. 6,202,772.

(51) Int. Cl.
*E21B 10/48* (2006.01)

(52) U.S. Cl. ..... 175/432; 175/430; 175/431

(58) Field of Classification Search ..... 175/432, 175/430, 431

See application file for complete search history.

(56) References Cited

U.S. PATENT DOCUMENTS

| | | | | | |
|---|---|---|---|---|---|
| 4,629,373 | A | * | 12/1986 | Hall | 407/118 |
| 5,217,081 | A | * | 6/1993 | Waldenstrom et al. | 175/420.2 |
| 5,332,051 | A | * | 7/1994 | Knowlton | 175/430 |
| 5,351,772 | A | * | 10/1994 | Smith | 175/428 |
| 5,435,403 | A | * | 7/1995 | Tibbitts | 175/432 |
| 5,484,330 | A | * | 1/1996 | Flood et al. | 451/540 |
| 5,486,137 | A | * | 1/1996 | Flood et al. | 451/540 |
| 5,494,477 | A | * | 2/1996 | Flood et al. | 451/540 |
| 5,564,511 | A | * | 10/1996 | Frushour | 175/431 |
| 5,590,727 | A | * | 1/1997 | Tank et al. | 175/374 |
| 5,590,728 | A | * | 1/1997 | Matthias et al. | 175/432 |
| 5,605,199 | A | * | 2/1997 | Newton | 175/432 |
| 5,617,928 | A | * | 4/1997 | Matthias et al. | 175/432 |
| 5,622,233 | A | * | 4/1997 | Griffin | 175/432 |
| 5,709,279 | A | * | 1/1998 | Dennis | 175/430 |
| 5,711,702 | A | * | 1/1998 | Devlin | 451/540 |
| 5,816,347 | A | * | 10/1998 | Dennis et al. | 175/432 |
| 5,881,830 | A | * | 3/1999 | Cooley | 175/428 |
| 5,887,580 | A | * | 3/1999 | Eyre | 125/36 |

(Continued)

*Primary Examiner*—Hoang Dang
(74) *Attorney, Agent, or Firm*—Christie, Parker & Hale, LLP

(57) ABSTRACT

The present invention provides a cutting element having a cylindrical body having a canted end face on which is formed an ultra hard material layer and to a bit incorporating such cutting element. One or a plurality of transition layers may be provided between the ultra hard material layer and the cutting element body.

8 Claims, 8 Drawing Sheets

U.S. PATENT DOCUMENTS 5,971,087 A * 10/1999 Chaves ..... 175/432
5,979,577 A * 11/1999 Fielder ..... 175/431
6,000,483 A * 12/1999 Jurewicz et al. ..... 175/428
6,009,963 A * 1/2000 Chaves et al. ..... 175/432
6,011,232 A * 1/2000 Matthias ..... 219/69.17
6,021,859 A * 2/2000 Tibbitts et al. ..... 175/431
6,065,554 A * 5/2000 Taylor et al. ..... 175/430
6,068,071 A * 5/2000 Jurewicz ..... 175/432
6,082,474 A * 7/2000 Matthias ..... 175/432
6,193,001 B1 * 2/2001 Eyre et al. ..... 175/432
6,202,771 B1 * 3/2001 Scott et al. ..... 175/432
6,991,049 B2 * 1/2006 Eyre et al. ..... 175/432
7,165,636 B2 * 1/2007 Eyre et al. ..... 175/432
7,395,885 B2 * 7/2008 Eyre et al. ..... 175/432

* cited by examiner

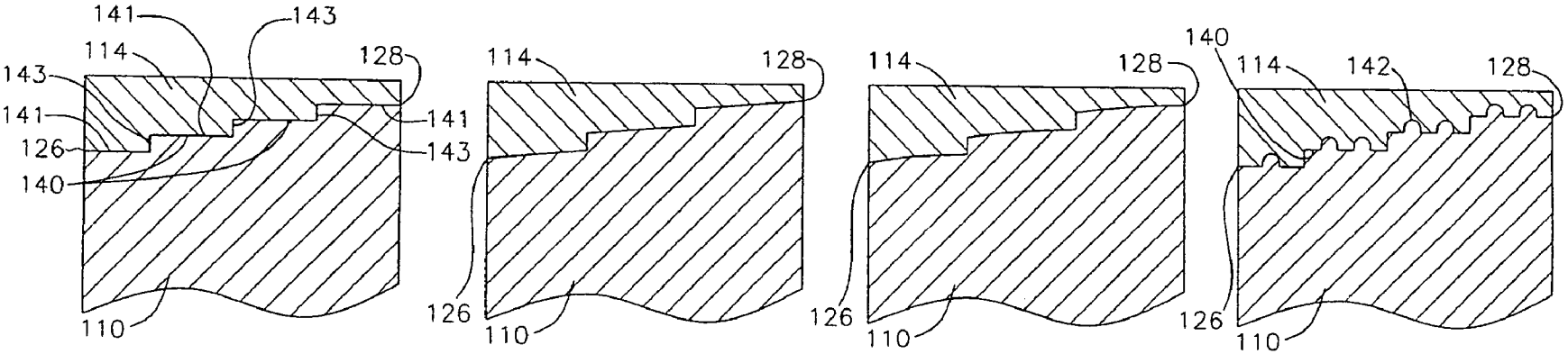
FIG. 7A
FIG. 7B
FIG. 7C
FIG. 7D
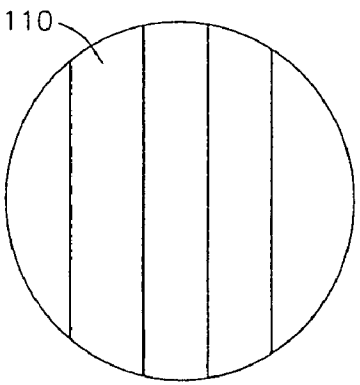
FIG. 8A
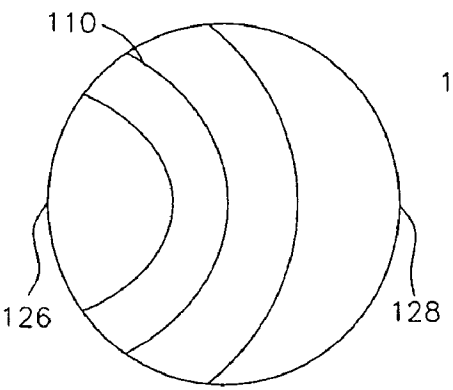
FIG. 8B
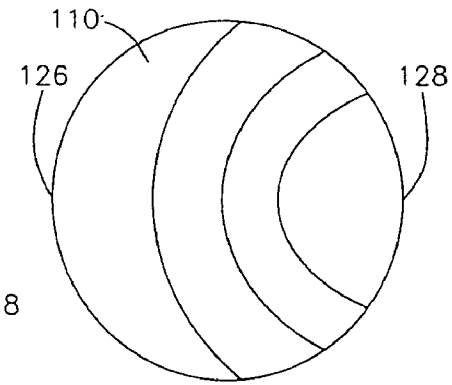
FIG. 8C
FIG. 8D

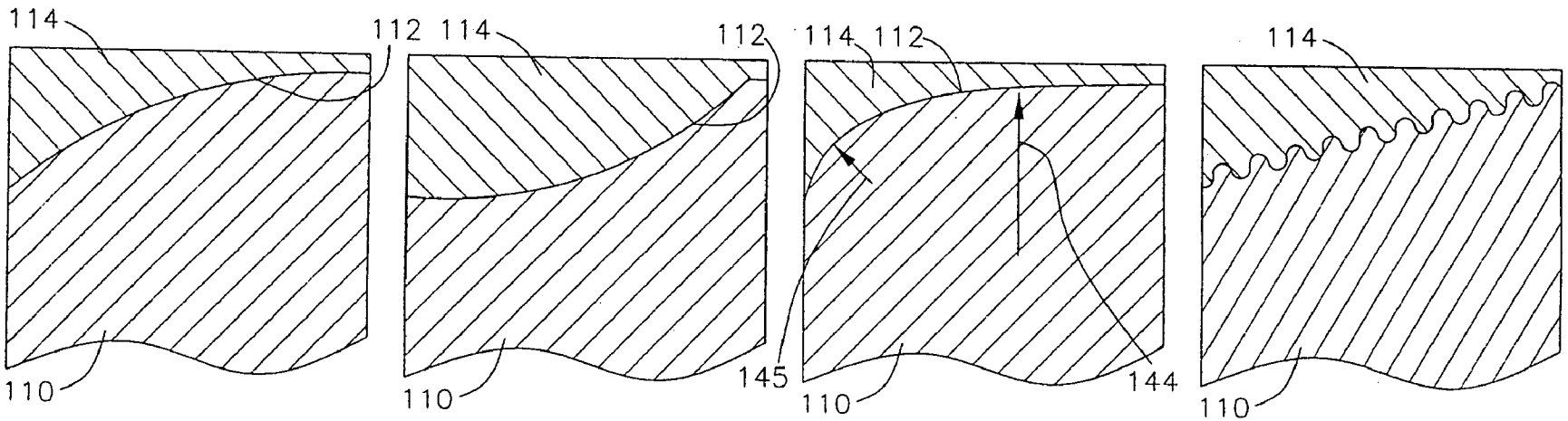
FIG. 9A
FIG. 9B
FIG. 9C
FIG. 9D
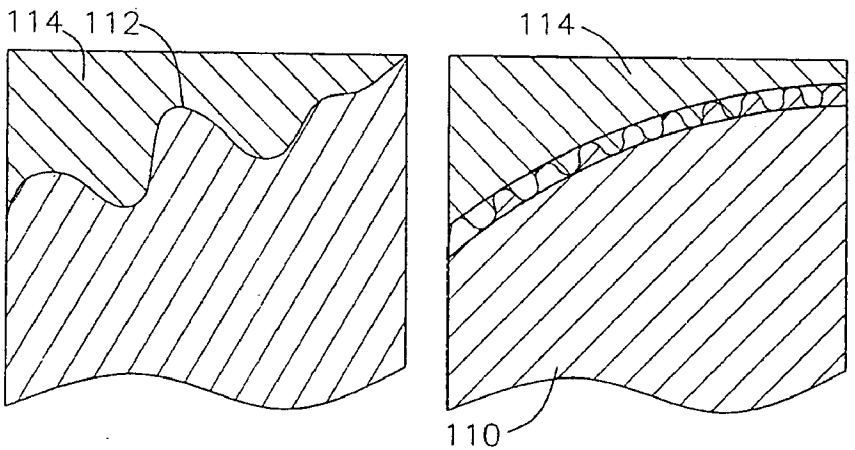
FIG. 9E
FIG. 9F

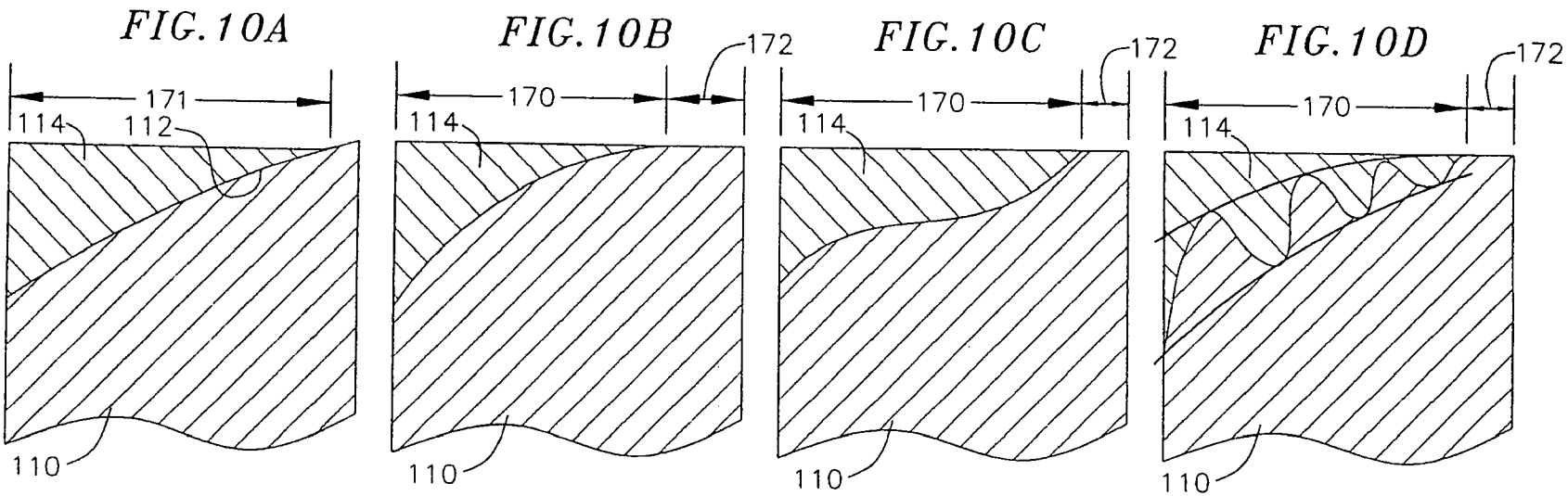
FIG. 10A
FIG. 10B
FIG. 10C
FIG. 10D
110
112
114
170
171
172
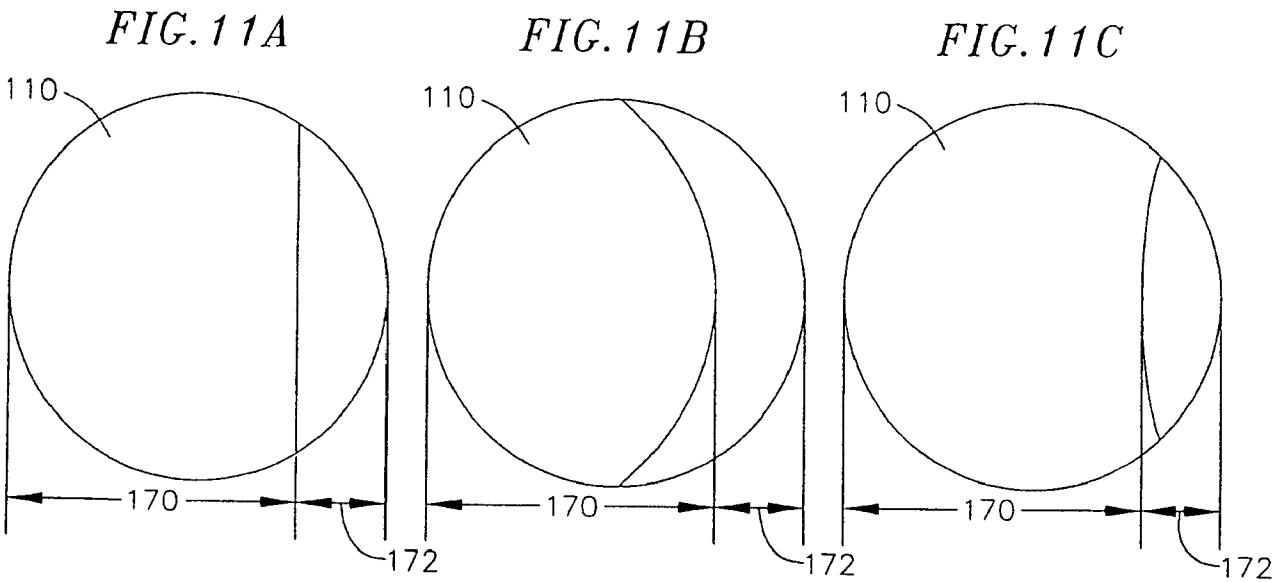
FIG. 11A
FIG. 11B
FIG. 11C
110
170
172

CUTTING ELEMENT WITH CANTED INTERFACE SURFACE AND BIT BODY INCORPORATING THE SAME

CROSS-REFERENCE TO RELATED APPLICATIONS

This application is a Continuation of U.S. patent application Ser. No. 11/657,198, filed Jan. 23, 2007, which will issue as U.S. Pat. No. 7,395,885 on Jul. 8, 2008, which is a Continuation of U.S. patent application Ser. No. 11/267,644 filed on Nov. 4, 2005 which issued as U.S. Pat. No. 7,165,636 on Jan. 23, 2007, which is a Continuation of U.S. patent application Ser. No. 10/079,293, filed on Feb. 20, 2002, and issued as U.S. Pat. No. 6,991,049 on Jan. 31, 2006, which is a Continuation of U.S. patent application Ser. No. 09/693,028, filed on Oct. 20, 2000, and issued as U.S. Pat. No. 6,405,814, which is a Divisional of U.S. patent application Ser. No. 09/103,824, filed on Jun. 24, 1998, now issued as U.S. Pat. No. 6,202,772.

BACKGROUND OF THE INVENTION

This invention relates to cutting elements for use in rock bits and more specifically to cutting elements which have a body with a canted cutting face on which is formed an ultra hard material cutting layer.

A cutting element, such as a shear cutter as shown in FIG. 1, typically has a cylindrical cemented tungsten carbide body 10. The cylindrical body has a cutting face forming the interface 12. An ultra hard material layer 14 is formed over the cutting face. The ultra hard material layer is typically polycrystalline diamond or polycrystalline cubic boron nitride. The ultra hard material layer typically has a planar or dome-shaped upper surface 16.

Shear cutters are generally mounted in preformed openings 22 on a bit body 18 at a rake angle 20 typically in the order of 10°-20° (FIGS. 2 and 3). These openings have rear support walls 23. The cutters are brazed to the rear support walls. Typically, a 90°-180° portion 24 of the cylindrical body outer surface is brazed to the rear support wall (FIG. 4). The brazed portions of the cutter body and rear support wall are sometimes referred to as the critical brazing area. During drilling, the portion of the cutting layer opposite the critical brazing area is subjected to high impact loads which often lead to crack formations on the cutting layer as well as to the delamination of the layer from the cutter body. Moreover, these high impact loads tend to speed up the wear of the cutting layer. The component 138 of the impact load which is normal to the earth formations is a severe load because it is reacting the weight of the bit body as well as the drill string. A majority of this load is reacted in shear along the interface between the cutting layer and the cutter body. This shear force promotes the delamination of the cutting layer from the cutter body.

To improve the fatigue, wear and impact lives of the ultra hard material layer as well as to improve the layer's delamination resistance, it is common to increase the thickness of the ultra hard material layer. However, an increase in the volume of ultra hard material results in an increase in the magnitude of the residual stresses formed at the interface between the ultra hard material layer and the cutter body.

Because the overall length of the cutter has to remain constant for mounting in existing bits having the preformed openings 22, the increase in the thickness of the ultra hard material layer results in a decrease in the length of the cutter body. Consequently, the cutter body surface area available for brazing is reduced leading to an increased occurrence of cutter fall out during drilling. Cutter retention, is therefore, reduced when the ultra hard material layer thickness is increased.

Other efforts currently being made to improve the fatigue and wear lives as well as the delamination resistance of the cutting layer, include the optimization of the interface geometry between the cutting layer and the cutter body. By varying the geometry of this interface, as for example by making the interface non-uniform, the magnitude of the residual stresses formed on the interface due to the coefficient of thermal expansion mismatch between the ultra hard material layer and the cutter body is reduced.

Currently, there is a need for cutters having improved ultra hard material layer fatigue, wear and delamination characteristics without a reduction in cutter retention.

SUMMARY OF THE INVENTION

The present invention provides a cutting element and a method for making the same. The inventive cutting element has a cylindrical body being made from a hard material such as tungsten carbide, which has a canted end surface. The cutting element or cutter body length, therefore, decreases diametrically across the end surface. The canted end face of the cutter can be planar, curved both in a convex or concave fashion, may be stepped and may be non-uniform in cross-section. An ultra hard material layer, such as polycrystalline diamond or polycrystalline cubic boron nitride is formed over the canted surface. The upper surface of the ultra hard material layer is typically flat or dome-shaped. As such the thickness of the ultra hard material layer increases diametrically across the cutter end face. One or multiple transition layers may be incorporated between the ultra hard material layer and the cutter body.

When mounted on a bit body, the longer outer surface of the outer body and its adjacent portions are brazed to preformed openings on the bit body. The ultra hard material layer portion opposite the brazed area is the portion that makes contact with the earth formations during drilling.

The inventive cutter allows for an increased thickness of ultra hard material in the area making contact with the earth formation and which is subject to the impact loads while at the same time providing a relatively unchanged cutter body surface area which is brazed to the bit body. In this regard, the delamination resistance of the ultra hard material layer as well as its wear resistance and fatigue strength are increased, without effecting the retention of the cutter within the bit. Moreover, by varying the thickness of the ultra hard material layer across the end face, the volume of the ultra hard material may remain unchanged as compared to conventional cutting elements thereby not increasing the residual stretches that may be formed at the interface between the ultra hard material layer and the cutter body. In this regard the delamination resistance of the ultra hard material layer is not decreased due to the increase in the layer thickness making contact with the earth formations.

One way to form cutter bodies having canted interfaces is to first form a cylindrical work piece having a diameter twice the diameter of the desired cutting element body and having a convex protrusion. A cylindrical cutting element body is then cut preferably using EDM from the work piece such that it is tangential to the work piece outer surface and to the work piece central axis. A second body may be cut which is also tangential to the work piece outer surface and which is tangential to the first cutting element body at the work piece central axis. Both bodies may be cut simultaneously.

DESCRIPTION OF THE DRAWINGS

FIG. 7A is a cross-sectional view of a cutter having a body having a stepped canted interface.

FIG. 7B is a cross-sectional view of a cutter having a body having a canted interface on which are formed steps having a canted upper surface.

FIG. 7C is a cross-sectional view of a cutter having a body having a canted interface on which are formed steps having a curved upper surface.

FIG. 7D is a cross-sectional view of a cutter having a body having a canted interface on which are formed steps having a non-uniform upper surface.

FIG. 8A is a top view of a cutter body having a canted interface on which are formed zig-zag steps.

FIG. 8B is a top view of a cutter body having a canted interface on which are formed curved steps curving toward the lower edge of the canted face.

FIG. 8C is a top view of a cutter body having a canted interface on which are formed curved steps curving toward the higher edge of the canted face.

FIG. 8D is a top view of a cutter body having a canted interface on which are formed linear chord-wise steps.

FIG. 9A is a cross-sectional view of a cutter having a convex canted interface.

FIG. 9B is a cross-sectional view of a cutter having a concave canted interface.

FIG. 9C is a cross-sectional view of a cutter having a canted interface having two different radii of curvature.

FIGS. 9D, 9E and 9F are cross-sectional views of cutters having non-uniform canted interfaces.

FIG. 10A is a cross-sectional view of a cutter having a canted interface over part of which is formed an ultra hard material layer.

FIGS. 10B, 10C and 10D are cross-sectional views of cutters each having only a portion of its interface canted and an ultra hard material layer formed over the canted portion.

FIGS. 11A, 11B and 11C are top views of cutter partially canted interfaces.

DETAILED DESCRIPTION OF THE INVENTION

Figure 1:
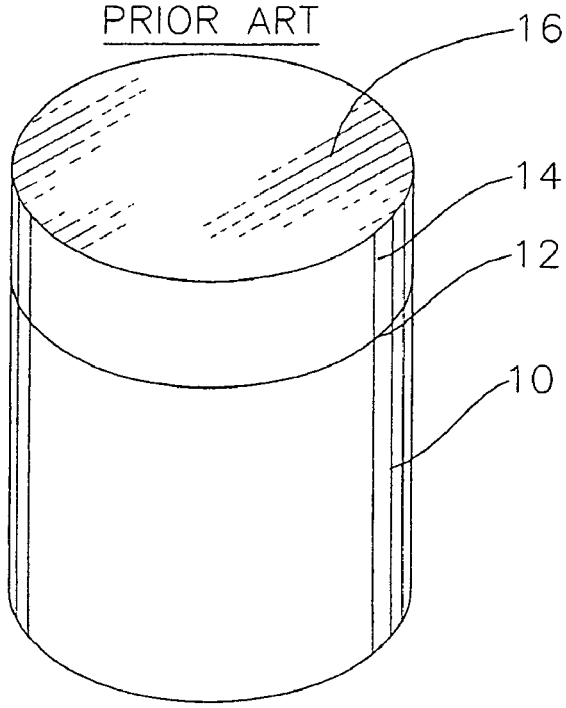
FIG. 1 PRIOR ART
FIG. 1 is a perspective view of a conventional shear cutter.
Figure 3:
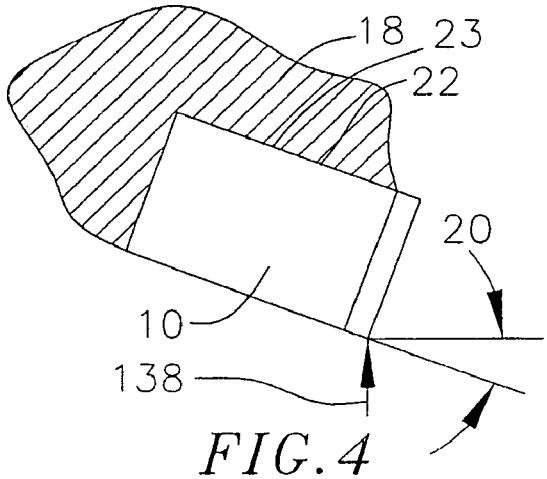
FIG. 3 PRIOR ART
FIG. 3 is a partial cross-sectional view of a shear cutter mounted on the bit body of FIG. 2.
Figure 4:
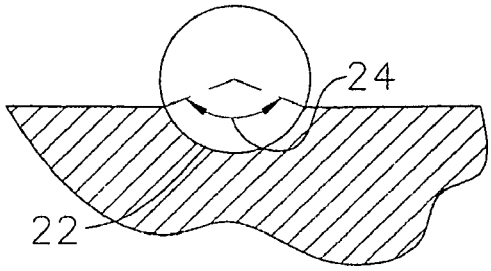
FIG. 4 PRIOR ART
FIG. 4 is a partial top view of a shear cutter mounted on the bit body of FIG. 2.
Figure 2:
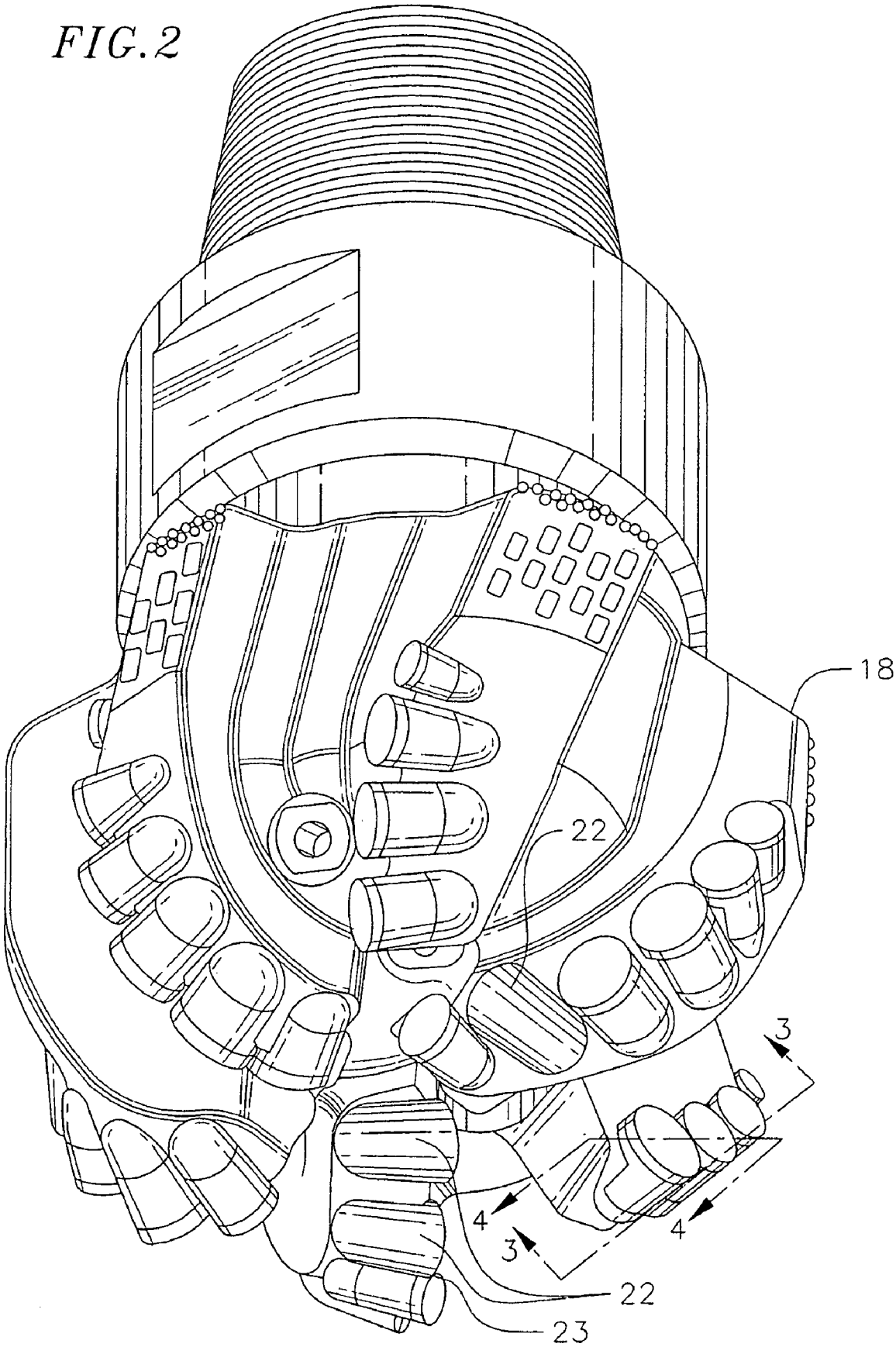
FIG. 2 is a perspective view of a drag bit with mounted shear cutters.
Figure 5A:
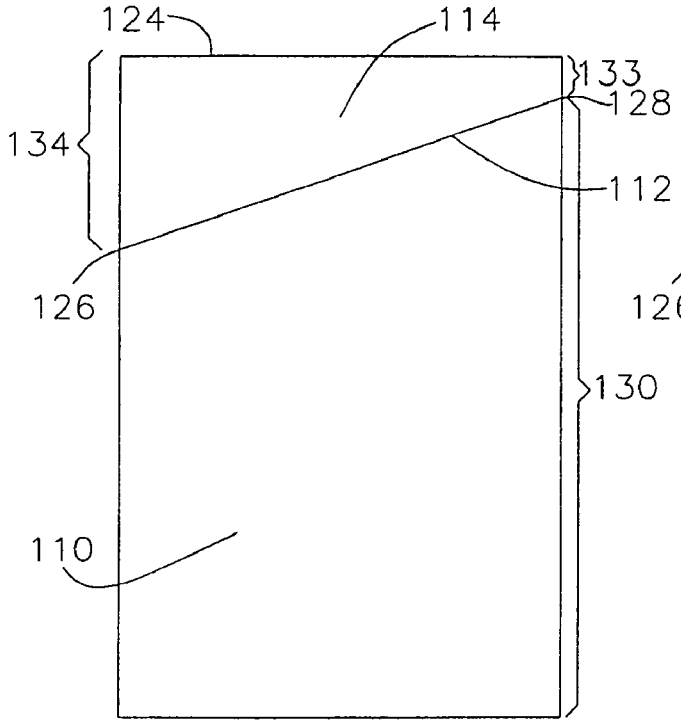
FIG. 5A is a cross-sectional view of a shear cutter having a canted interface on top of which is formed a cutting layer having a flat upper surface.
Figure 5B:
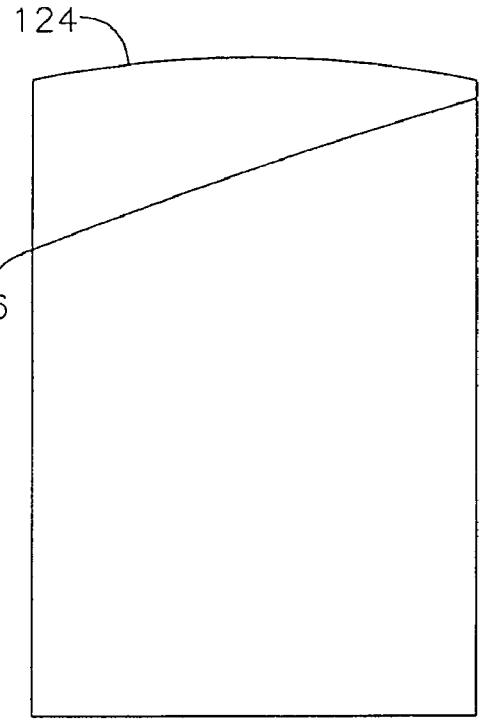
FIG. 5B is a cross-sectional view of the shear cutter having a canted interface on top of which is formed a cutting layer having a dome-shaped upper surface.

The cutting elements or cutters of the present invention have a body 110 with a canted cutting face forming interface 112 (FIG. 5A). Stated differently, the interface is sloped. An ultra hard material layer 114 is formed over the canted interface. The upper surface 124 of the ultra hard material layer typically remains flat such that the thickness of the ultra hard material layer is minimum adjacent the highest point 128 on the interface and maximum adjacent the lowest point 126 on the canted face. Alternatively, the upper surface of the ultra hard material layer is dome-shaped (FIG. 5B). However, the radius of the dome-shaped surface is preferably relatively large such that the thickness of the ultra hard material layer is still maximum adjacent the lowest point 126 on the canted face. Preferably, the thinnest portion 133 of the ultra hard material layer should be in the order of 10-20% of the thickness of the thickest portion 134.

The overall length of the cutter of the present invention remains the same as that of a conventional cutter allowing for mounting into existing bit bodies. The cutter body outer surface longest length 130 as measured from the highest point 128 on the interface is the same or longer than the length of conventional cutter bodies. The length of the cutter along the lowest point of the interface is less than or equal to the length of conventional cutter bodies.

Figure 6:
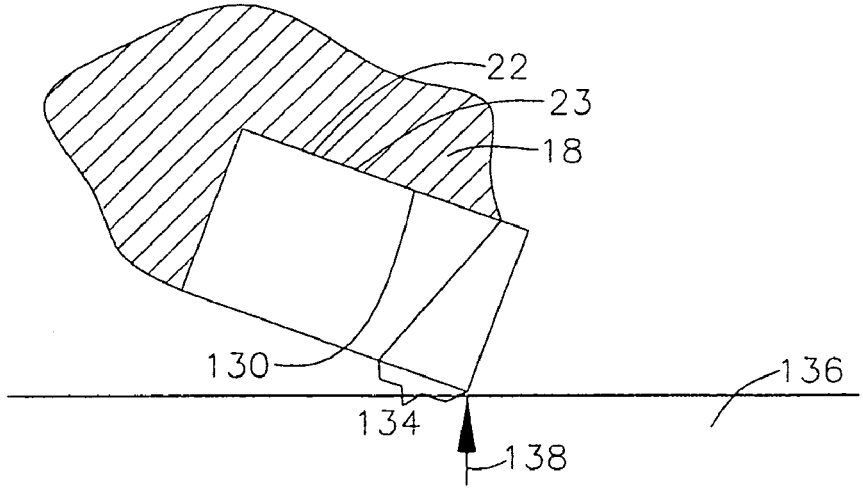
FIG. 6 is a partial cross-sectional view depicting the cutter of FIG. 5A mounted on a bit body.

The cutters are mounted in the preformed openings 22 having a rear support wall 23 on the bit body 18 with the longest portion of the cutter outer surface 130 facing the rear support wall such that it becomes the surface of the cutter that is brazed to the bit body (FIG. 6). In other words, the longest cutter surface 130 is within the cutter critical braze area. Since the longest outer surface of the cutter is the same or longer than the outer surface of conventional cutters, the cutter brazing critical area remains almost the same as the brazing critical area of conventional cutters. However, in comparison to conventional cutters with increased thickness ultra hard material layers, the overall brazing area on the cutter body is increased.

When brazed on a bit, the thickest portion 134 of the ultra hard material cutting layer is positioned opposite the brazing critical area so as to make contact with the earth formations 136 during drilling. Consequently, this thickest portion of the cutting layer is the portion that is subjected to the impact loads during drilling.

Thus, the cutters of the present invention are optimized to have an ultra hard material cutting layer with an increased thickness at the location where the cutting layer impacts the earth formations while at the same time maintaining the cutters critical brazing surface area which is brazed to a bit body. As a result, the cutters of the present invention have an increased cutting layer delamination and wear resistance as well as fatigue life due to the increase in the thickness of the ultra hard material that is subject to impact loads, without reducing the cutter retention life when brazed to a bit body.

The canted interface increases the offset of the interface from the severe impact loads 138 applied to the cutting layer during drilling. These loads are normal to the earth formation being drilled. As a result, the cant in the interface, reduces the portion of the impact load that is reacted in shear along the interface, thus reducing the shear stress along the interface. Consequently, the risk of cutting layer delamination is decreased.

Moreover, the canted interface allows for a distribution of the ultra hard material layer thickness without increasing the volume of the ultra hard material when compared to the volume of the ultra hard material in conventional cutters. As a result, the magnitude of the residual stresses formed on the interface between the cutter body and the ultra hard material layer do not increase by the increase in the thickness of the ultra hard material layer portion making contact with the earth formations.

In an exemplary embodiment, the canted interface is planar as shown (FIG. 5A). In another embodiment the canted interface is formed by a series of steps 140 along the interface (FIG. 7A). These steps ascend from a first point 126 to a second point 128 on the interface. These steps include an upper surface 141 and a riser 143. The upper surface 141 of these steps may be flat (FIG. 7A) or canted (i.e., sloped) themselves (FIG. 7B). The upper surface of the steps may also be curved (FIG. 7C). In further embodiments, the steps 140 may have upper surfaces 142 which are non-uniform (FIG. 7D). Of course, as is apparent to one skilled in the art, the steps themselves form a non-uniform face for interfacing with the cutting layer or with a transition layer. The steps may zig-zag across the interface (FIG. 8A), or they may curve towards the lower edge 126 of the canted interface (FIG. 8B) or toward the higher edge 128 of the canted interface (FIG. 8C) forming horseshoe shapes or may be linear (FIG. 8D) across the canted interface.

As used herein, a uniform interface (or surface) is one that is flat or always curves in the same direction. This can be stated differently as an interface having the first derivative of slope always having the same sign. Thus, for example, a conventional polycrystalline diamond-coated convex insert for a rock bit has a uniform interface since the center of curvature of all portions of the interface is in or through the carbide substrate.

On the other hand, a non-uniform interface is defined as one where the first derivative of slope has changing sign. An example of a non-uniform interface is one that is wavy with alternating peaks and valleys. Other non-uniform interfaces may have dimples, bumps, ridges (straight or curved) or grooves, or other patterns of raised and lowered regions in relief.

The steps on the canted interface provide for an increased surface area for bonding of the ultra hard material layer to the cutter body. The increased surface area also provides a reduction in the shear stresses reacted along the interface thereby enhancing the delamination resistance of the cutter. Moreover, the steps tend to reduce the effects of the coefficient thermal expansion mismatch between the ultra hard material layer and the cutter body along the canted interface thereby decreasing the residual stresses that are formed along the canted face, and as a result increase the fatigue life and delamination resistance of the cutter.

Figure 9G:
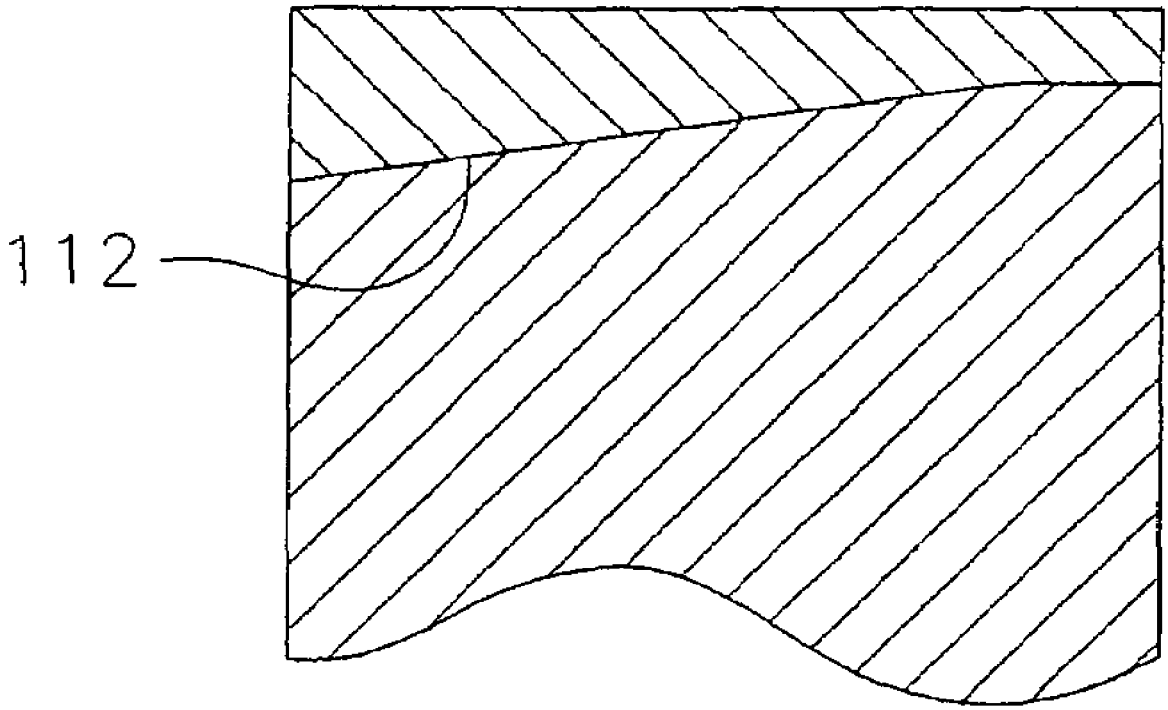
FIG. 9G is a cross-sectional view of a cutting having a planar canted interface.

In a further embodiment, the interface 112 may curve along the cant in a convex (FIG. 9A) or concave (FIG. 9B) fashion or may be planar as shown in FIG. 9G. In one embodiment, the canted face has a larger radius 144 at the higher portion of the canted surface and a smaller radius 145 at the lower portion of the canted face (FIG. 9C). Moreover, the canted interface itself may be non-uniform in cross section for forming a non-uniform interface with a cutting layer (FIGS. 9D and 9E). Furthermore, the non-uniformities may follow a curved cant as shown for example in FIG. 9F. Again, the non-uniformities will reduce the residual stresses formed on the canted interface thereby enhancing the delamination resistance of the cutting layer.

It has been discovered by the applicants that with conventional cutters mounted on a bit body, microcracking occurs on the ultra hard material layer immediately adjacent the support wall of the openings onto which the cutters are mounted. This microcracking eventually leads to the chipping of the ultra hard material layer. It is believed that the microcracking is caused by either or both of the following two reasons. First it is believed that the heat during brazing causes the brazing flux to chemically react with the portion of the ultra hard material layer adjacent the opening support wall causing "braze poisoning" of the ultra hard material layer. This braze poisoning weakens the ultra hard material layer leading to the formation of microcracks. Secondly, it is believed that at least a portion of the impact loads imparted on the cutting layer are reacted at the rear support wall through the portion of the ultra hard material adjacent to the rear support wall. These loads tend to cause chipping of the ultra hard material layer adjacent the rear support wall.

To overcome this problem, in further embodiments, the ultra hard material layer is placed only over a portion 171 of the canted interface so as not to extend to the support wall of the opening when mounted on a bit body (FIG. 10A). In some embodiments (FIGS. 10B, 10C and 10D) only a portion 170 of the interface is canted and the ultra hard material is placed only over the canted portion. The portion of the interface 172 that will be positioned adjacent to the rear support wall remains uncanted. Preferably, when viewed in cross-section, about ⅓ of the diameter of cutter interface is uncanted (i.e., only about ⅔ of the diameter is canted) as for example shown in FIGS. 10A, 10B and 10C. When only a portion of the interface is canted, the boundary between the canted and uncanted portions of the interface may be linear as shown in FIG. 11A or curved as shown, for example, in FIGS. 11B and 11C.

With these embodiments, since the ultra hard material layer is preferably only placed over the canted portion of the interface, it does not extend to the support wall of the bit opening when the cutter is mounted on a bit body. As such, all of these embodiments ensure that the ultra hard material layer of the cutter remains away from the braze area, i.e., the rear support wall, and thus is not prone to braze poisoning. Moreover, the impact loads will not be reacted through the portion of the ultra hard material layer closest to the support walls.

Figure 12C:
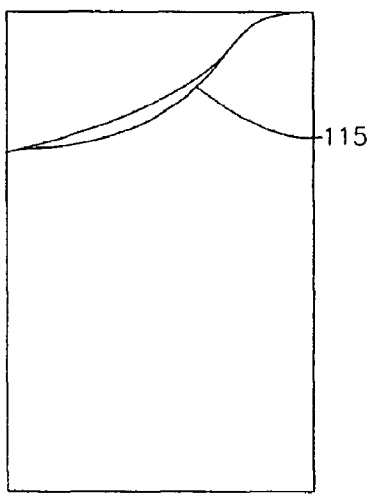
FIG. 12C is a cross-sectional view of a cutter having a partial canted interface and an encapsulated transition layer formed over the partially canted interface.
Figure 12B:
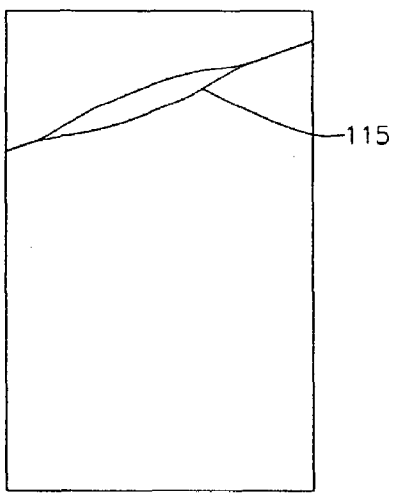
FIG. 12B is a cross-sectional view of a cutter having a canted interface and having an encapsulated transition layer formed over the canted interface.
Figure 12A:
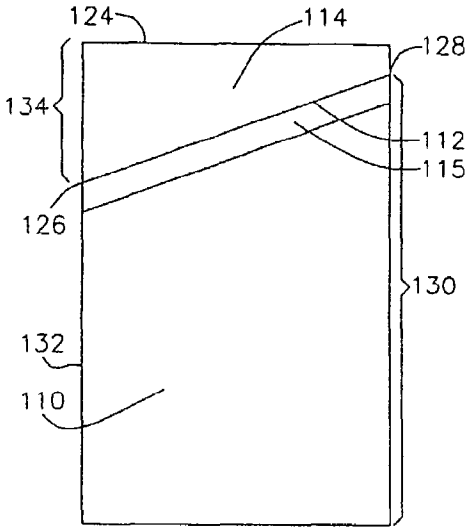
FIG. 12A is a cross-sectional view of a cutter having a canted interface and having a transition layer formed over the canted interface.

With any of these embodiments, a single (FIG. 11A) or multiple transition layers 115 may be formed between the canted face and the ultra hard material cutting layer. The transition layer(s) should preferably be made from a material having properties which after processing are intermediate between the ultra hard material layer and the cutter body. The transition layer or layers may also be encapsulated as shown in FIGS. 12B and 12C.

Moreover, as can be seen in the exemplary embodiments shown in FIGS. 8A-8D and 11A-11C, the interface surface of such cutters, are symmetric about a plane. With some exemplary embodiment cutters, as for example shown in FIGS. 7A-7C, 9A-9C and 10A-10C, the ultra hard material layer thickness is at a maximum and at a minimum along this plane.

Figure 13B:
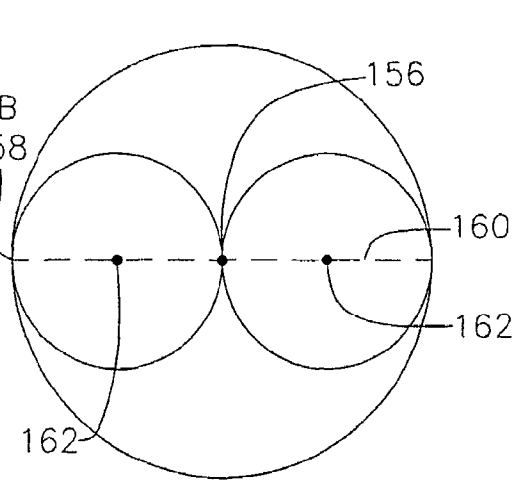
FIG. 13B is a top view of the work piece shown in FIG. 10A depicting the cuts for forming two cutter bodies.
Figure 13A:
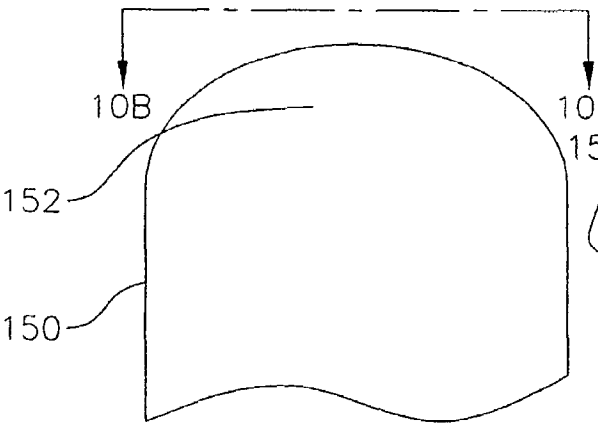
FIG. 13A is a cross-sectional view of a cylindrical work piece from which are cut forming cutter bodies having canted interfaces.

While there are many ways to form the body of a cutter having a canted surface, one method calls for the formation of a cylindrical work piece 150 having a dome shaped (or convex) upper protrusion 152 (FIG. 13A). The work piece should have a diameter 160 twice the diameter of the desired cutter body. To form the cylindrical cutter body having the canted interface, preferably EDM is used to cut the cutter body tangential to the central axis 156 of the cylindrical work piece and tangential to the outer surface 158 of the cylindrical work piece (FIG. 13B). In a preferred embodiment, two cutter bodies may be cut simultaneously which are tangential along the work piece central axis 156 and which have their central axes 162 along a diameter 160 of the work piece as shown in FIG. 13B.

What is claimed is:

1. A cutting element comprising:

a hard material body having an end surface symmetrical about a plane and a periphery defining a circumference, the end surface comprising a first portion extending to the periphery and a second canted portion extending to the periphery, wherein the first portion intersects the periphery along a first periphery line and wherein the second portion intersects the periphery along a second periphery line, wherein the second periphery line extends from one end of the first periphery line to another end of the first periphery line, wherein at least one of the first and second portions when viewed in cross-section along the plane is not linear; and an ultra hard material layer formed over the end surface having an exposed upper surface, said ultra hard material layer having a periphery and extending over both the first and second portions, wherein the ultra hard material layer comprises a thickness, wherein the thickness of the ultra hard material layer is maximum at a first location at the periphery of the ultra hard material layer at an intersection with the plane and wherein the thickness of the ultra hard material layer is minimum at a second location at the periphery of the ultra hard material layer at an intersection with the plane, wherein the second location is opposite the first location.

2. A cutting element as recited in claim 1 wherein the second periphery line extends around more than half of the circumference.

3. A cutting element as recited in claim 1 further comprising:

a first protrusion extending from said first portion; and a second protrusion extending from said second portion.

4. A cutting element as recited in claim 1 further comprising:

a first plurality of protrusions extending from said first portion; and a second plurality of protrusions extending from said second portion.

5. A cutting element as recited in claim 1 wherein the first portion intersects the second portion along a linear line.

6. A cutting element as recited in claim 1 wherein the first portion intersects the second portion along a non-linear line.

7. A cutting element as recited in claim 1 wherein said at least one of the first and second portions which is non-linear when viewed in cross-section along the plane has a curvature when viewed in cross-section along the plane that curves only in one direction.

8. A cutting element as recited in claim 1 wherein said at least one of the first and second portions which is non-linear when viewed in cross-section along the plane has a curvature when viewed in cross-section along the plane that curves in opposite directions.

* * * * *